US008256925B2

(12) United States Patent
Yuan

(10) Patent No.: US 8,256,925 B2
(45) Date of Patent: Sep. 4, 2012

(54) ROTATORY TABLE LAMP

(75) Inventor: Hui Yuan, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 221 days.

(21) Appl. No.: 12/763,189

(22) Filed: Apr. 19, 2010

(65) Prior Publication Data

US 2011/0216539 A1 Sep. 8, 2011

(30) Foreign Application Priority Data

Mar. 2, 2010 (CN) ..... 2010 1 0116064

(51) Int. Cl.
*F21S 4/00* (2006.01)
*F21S 8/08* (2006.01)
*F21V 21/30* (2006.01)

(52) U.S. Cl. ..... 362/249.07; 362/287; 362/413; 362/414

(58) Field of Classification Search ..... 362/249.03, 362/249.07, 249.1, 249.11, 269, 271, 285, 362/287, 371, 372, 413, 414, 427, 428, 431, 362/352, 410
See application file for complete search history.

(56) References Cited

U.S. PATENT DOCUMENTS

| | | | | |
|---|---|---|---|---|
| 1,745,396 | A * | 2/1930 | Adams | 439/535 |
| 5,620,247 | A * | 4/1997 | Swanson | 362/249.08 |
| 5,971,562 | A * | 10/1999 | Yang | 362/184 |
| 6,416,207 | B1 * | 7/2002 | Chang | 362/419 |
| 6,547,410 | B1 * | 4/2003 | Pederson | 362/35 |
| 6,966,678 | B2 * | 11/2005 | Hsieh | 362/406 |
| 7,547,126 | B2 * | 6/2009 | Hiratsuka | 362/413 |

FOREIGN PATENT DOCUMENTS

| | | |
|---|---|---|
| CN | 201145238 Y | 11/2008 |
| CN | 201159440 Y | 12/2008 |
| EP | 1855049 | 11/2007 |
| TW | 498964 | 8/2002 |
| TW | M338947 | 8/2008 |
| TW | M372922 | 1/2010 |

* cited by examiner

*Primary Examiner* — David Crowe
(74) *Attorney, Agent, or Firm* — Altis Law Group, Inc.

(57) ABSTRACT

A rotatory table lamp includes a base, a holder, a connection element, a rotation mechanism, a first lamp and a second lamp. One end of the holder is fixed in the center of the bas, and the other end is received in the connection element. The rotation mechanism is rotatably received in the connection element, the holder and the base. The first lamp is fixed on the connection element. The second lamp is fixed on the rotation mechanism, and is as the same structure of the first lamp.

16 Claims, 5 Drawing Sheets

ROTATORY TABLE LAMP

BACKGROUND

1. Technical Field

The present disclosure relates to table lamps and, particularly, to a rotatory table lamp.

2. Description of Related Art

Table lamps are widely used in homes. Usually a table lamp includes a base, a light emitting device, and a holder connecting the base and the light emitting device. The holder can also be adjustable to adjust the pose of the light emitting device conveniently. Although the table lamp is adjustable, the table lamp can only provide one lighting direction at a time, when more than one user need to use the table lamp for reading at the same time, users must sit in a relatively small area upon which the light emits. Reading like this may be disturbing for the users and can make them feel uncomfortable.

Therefore, what is needed is a rotatory table lamp alleviating the limitations described above.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
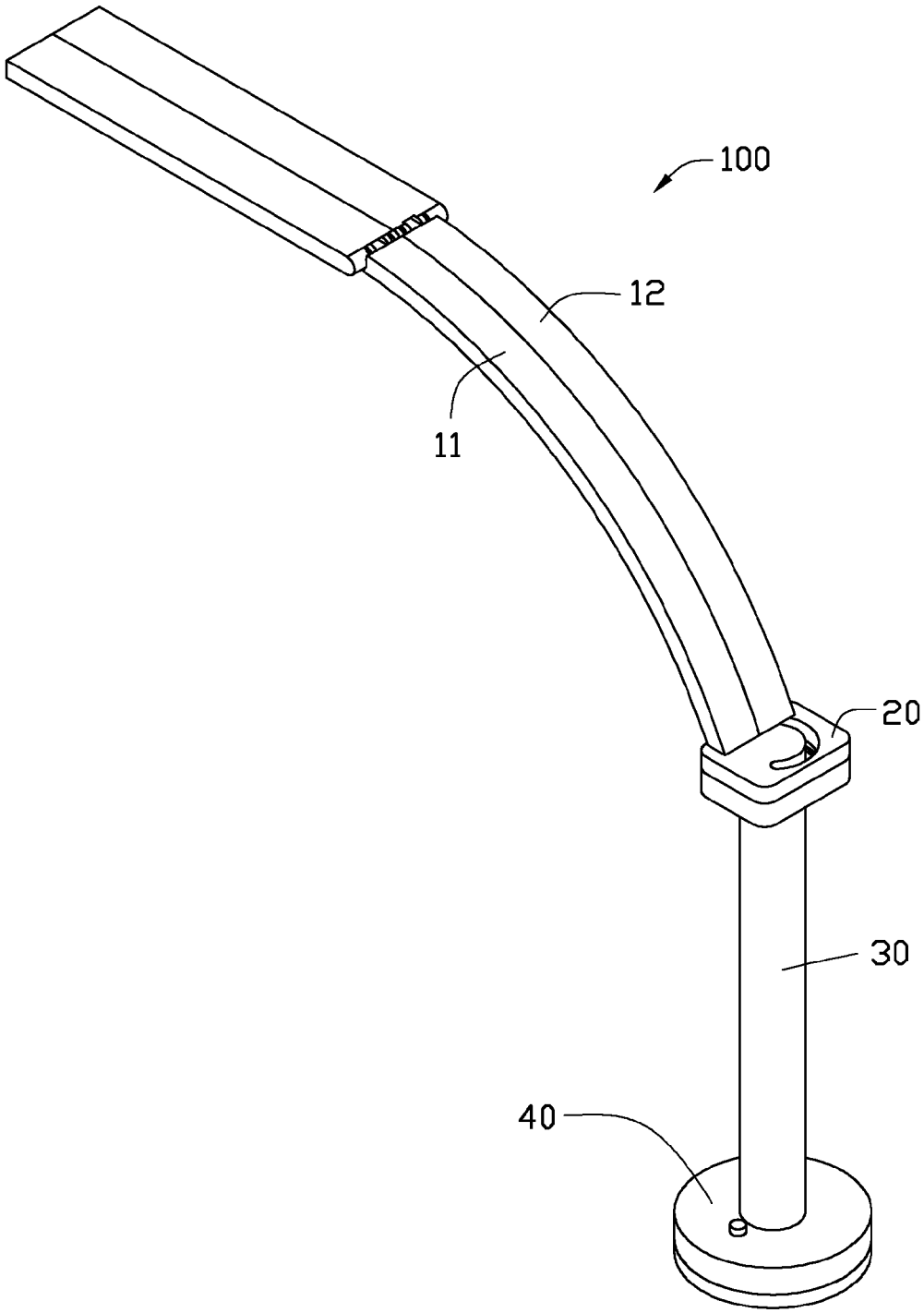
FIG. 1 is an isometric view of a rotatory table lamp according to an exemplary embodiment.

Referring to FIG. 1, a rotatory table lamp 100 is disclosed as an exemplary embodiment. The rotatory table lamp 100 includes a first lamp 11, a second lamp 12, a connection element 20, a holder 30, and a base 40 for supporting the rotatory table lamp 100. The first and second lamps 11 and 12 are connected to the connection element 20 through a first surface of the connection element 20. The holder 30 is column shaped. One end of the holder 30 is fixed to the connection element 20 at a second surface of the connection element 20. The second surface is opposite to the first surface. The other end of holder 30 is fixed in the center of the base 40. Power lines (not shown), transformer (not shown), and controlling elements (not shown) are accommodated in the holder 30 and the base 40.

Figure 2:
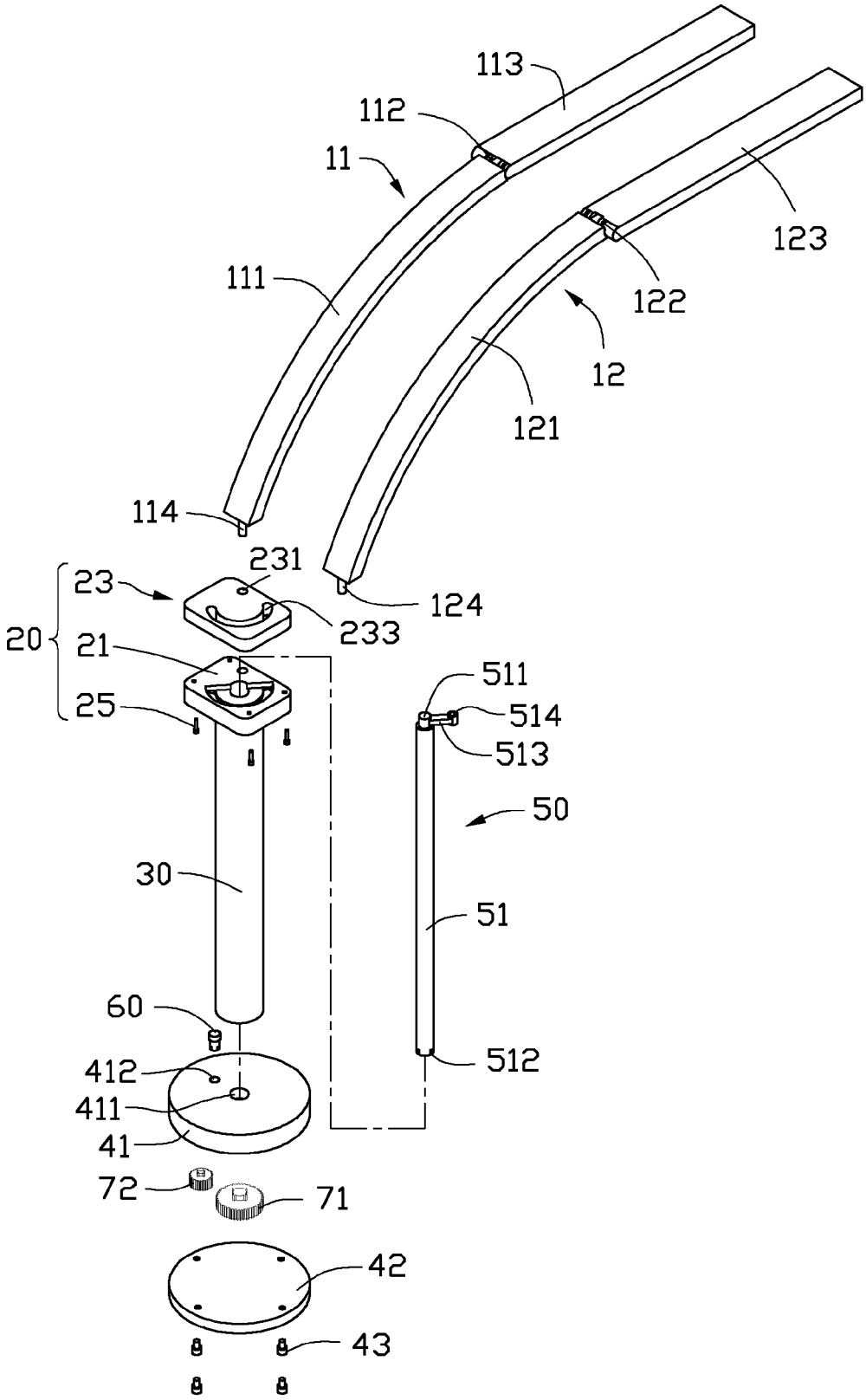
FIG. 2 is an exploded view of the rotatory table lamp of FIG. 1.

Referring to FIG. 2, the first lamp 11 includes a connection rod 111, a light emitting device 113 and a hinge 112 articulating the connection rod 111 and the light emitting device 113. The light emitting device 113 includes an LED tube (Light Emitting Diode tube) (not shown), and can rotate about the hinge 112 to adjust the light-transmitting direction of the rotatory table lamp 100. The connection rod 111 includes a connection dowel 114 at the end away from the hinge 112. The connection dowel 114 fixes the first lamp 11 into the connection element 20. The structure of the second lamp 12 is the same as the first lamp 11. The second lamp 12 includes a connection rod 121, a light emitting device 123 and a hinge 122 articulating the connection rod 121 and the light emitting device 123.

The connection element 20 includes a connection platform 21 and a connection cover 23. The connection cover 23 is mounted on the connection platform 21 via screws 25. The connection cover 23 defines a first through hole 231 and an arc-shaped through hole 233. The first through hole 231 is penetrated by the connection dowel 114 of the connection rod 111. The arc-shaped through hole 233 is penetrated by the connection dowel 124 of the connection rod 121.

Figure 3:
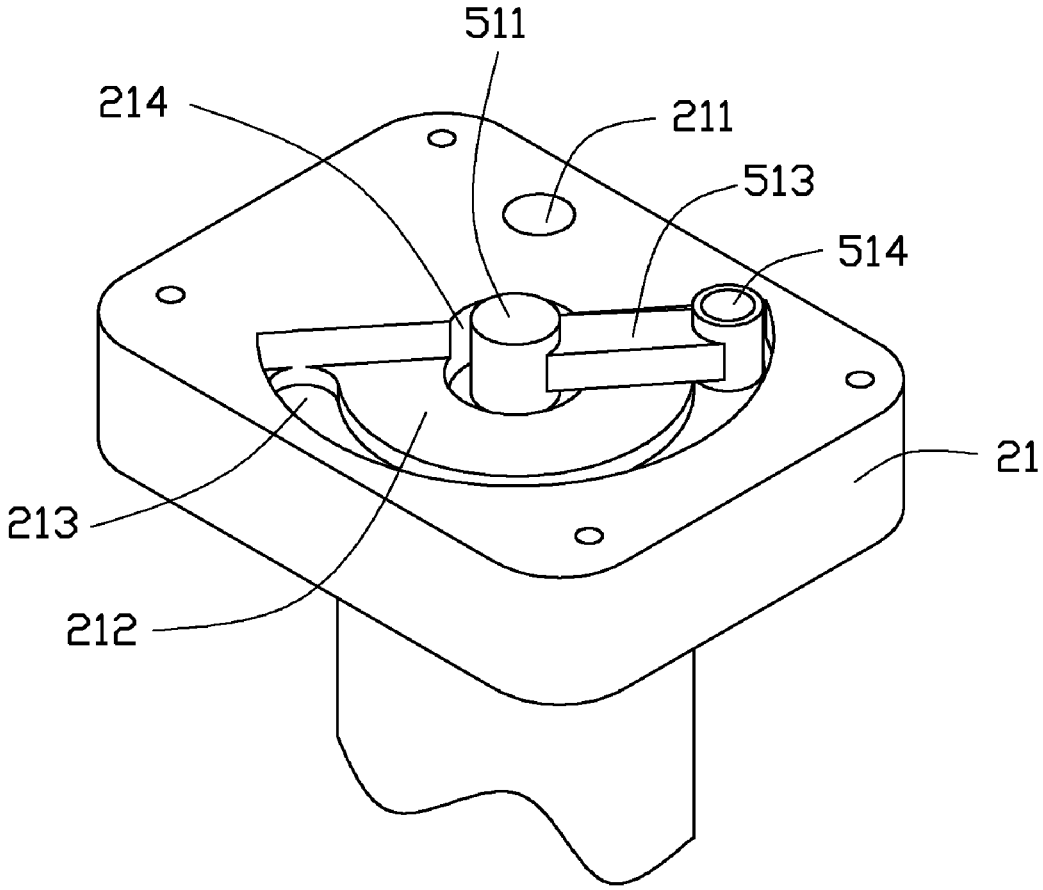
FIG. 3 is an enlarged view of the connection element of the rotatory table lamp of FIG. 1.

Referring to FIG. 3, the connection platform 21 defines a fixing hole 211, a second through hole 214 in the centre, a sectorial indented portion 212, and an arc-shaped sliding groove 213 corresponding to the arc-shaped through hole 233. The fixing hole 211 is coaxial with the first through hole 231 of the connection cover 23 and can receive and secure the connection dowel 114 of the connection rod 111. Thus the first lamp 11 is fixed on the connection element 20 via the connection dowel 114 penetrating the first through hole 231 and the fixing hole 211 sequentially. The radians of the sectorial indented portion 212 and the arc-shaped sliding groove 213 are 180 degrees. In other embodiments, the radians of the sectorial indented portion 212 and the arc-shaped sliding groove 213 can be designed according to actual needs.

Referring back to FIG. 2, the rotatory table lamp 100 further includes a rotation mechanism 50. The rotation mechanism 50 includes a rotation axis 51. The rotation axis 51 includes a first end 511 and an opposite second end 512. Together referring to FIG. 3, the rotation axis 51 is received in the holder 30, and the first end 511 protrudes from the second through hole 214 of the connection platform 21. The rotation mechanism 50 further includes a supporting arm 513 protruding radically from the first end 511 and rotatably received in the sectorial indented portion 212 of the connection platform 21. The supporting arm 513 includes a fixing portion 514 at a free end thereof. The fixing portion 514 is a cylindrical ring and rotatably received in the arc-shaped sliding groove 213 of the connection platform 21. The second lamp 12 is fixed on the rotation mechanism 50 via the connection dowel 124 of the connection rod 121, penetrates the arc-shaped through hole 233 and fixes in the fixing portion 514. The second end 512 of the rotation axis 51 is rotatably connected with the base 40.

Figure 4:
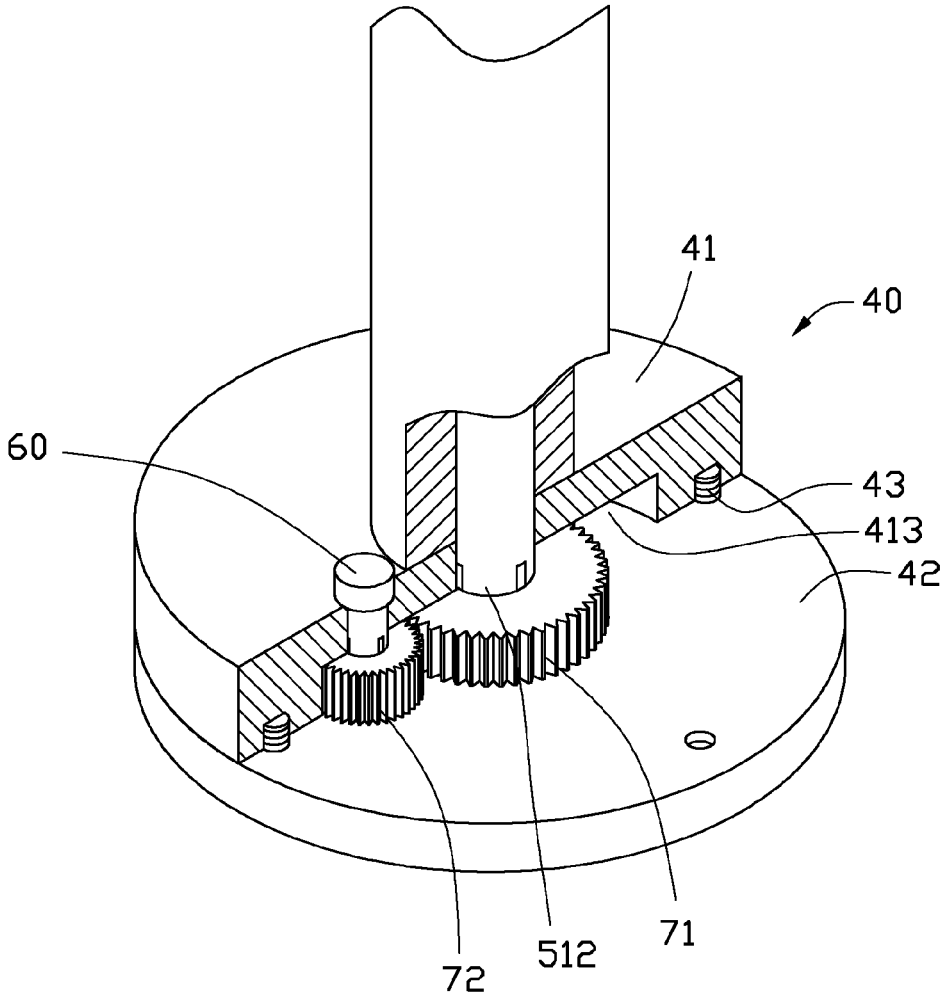
FIG. 4 is an enlarged, cutaway view of the base of the rotatory table lamp of FIG. 1.

Referring FIG. 2 and FIG. 4, the base 40 includes an upper body 41 and a lower body 42. The upper body 41 and the lower body 42 are connected to each other via screws 43. The upper body 41 defines a third through hole 411 in the center, and a fourth through hole 412. The upper body 41 and the lower body 42 define a cavity 413 therebetween. The rotation mechanism 50 further includes a knob 60, a first gear 71 and a second gear 72 engaged with the first gear 71. The first and second gears 71 and 72 are received in the cavity 413. The first gear 71 is located at the center of the bottom body 42. The knob 60 is fixed with a centre shaft of the second gear 72, and protrudes out of the upper body 41 through the fourth through hole 412. The second end 512 of the rotation axis 51 extends through the third through hole 411 of the upper body 41 and is received in a center hole of the first gear 71.

In use, when the knob 60 is turned by a user, the knob 60 drives the second gear 72 to rotate, and the second gear 72 drives the first gear 71, the rotation axis 51, the supporting arm 513 to rotate in turn. The fixing portion 514 of the supporting arm 513 rotates along the sliding groove 213 of the connection platform 21, thus the second lamp 12 fixed at the fixing portion 514 rotates about the rotation axis 51 accordingly.

Figure 5:
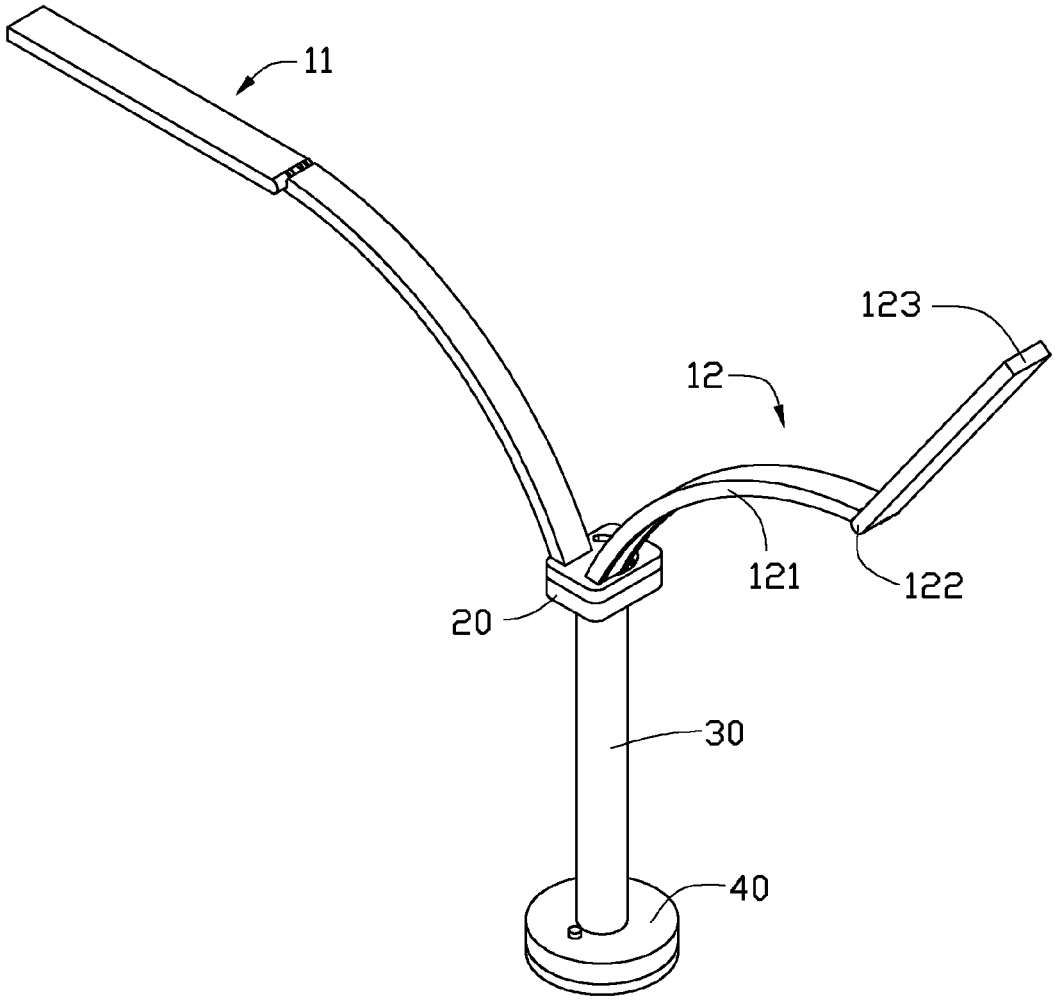
FIG. 5 is similar to FIG. 1, but showing the rotatory table lamp in a double-sided lighting state.

Referring to FIGS. 1 and 5 together, in FIG. 1, the lighting directions of the first and second lamps 11 and 12 are the same, users can turn on one or both of the first and second lamps 11 and 12 according to actual needs. The lighting area of the rotatory table lamp 100 can be adjusted by rotating the second lamp 12 and the light emitting devices 113 and 123. In FIG. 5, the rotatory table lamp 100 is in a double-sided lighting state. That is, the second lamp 12 is rotated to the side opposite to the first lamp 11. Two or more users can share the rotatory table lamp 100 for reading at the same time and adjust the lighting area of the rotatory table lamp 100.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A rotatory table lamp comprising:

a base a holder fixed on the base;

a connection element fixed on an end of the holder away from the base;

a rotation mechanism rotatably installed on the connection element;

a first lamp fixed on the connection element, the first lamp comprising a first connection rod, a first light emitting device and a first hinge joining the first connection rod and the first light emitting device; and a second lamp fixed on the rotation mechanism, the second lamp comprising the same elements as the first lamp: a second connection rod, a second light emitting device and a second hinge joining the second connection rod and the second light emitting device;

wherein the connection element comprises a connection platform and a connection cover mounted on the connection platform; the connection cover defines a first through hole and an arc-shaped through hole; and the connection platform defines a fixing hole coaxial with the first through hole, a second through hole in the center of the connection platform, a sectoral indented portion and an arc-shaped sliding groove corresponding to the arc-shaped through hole; wherein one end of the first lamp penetrates through the first through hole and the fixing hole and is fixed on the connection element; and one end of the second lamp penetrates through and rotatably slides along the arc-shaped through hole and is fixed on the rotation mechanism.

2. The rotatory table lamp as described in claim 1, wherein the rotation mechanism comprises a rotation axis, the rotation axis comprises a first end and a second end opposite to the first end; the first end protrudes from the second through hole, the second end is rotatably connected with the base.

3. The rotatory table lamp as described in claim 2, wherein the rotation mechanism further comprises a supporting arm protruding radially from the first end and rotatably received in the sectoral indented portion; the supporting arm comprises a fixing portion defined at the free end thereof and rotatably received in the arc-shaped sliding groove; and one end of the second lamp penetrates through the arc-shaped through hole and is fixed in the fixing portion.

4. The rotatory table lamp as described in claim 3, wherein the base comprises an upper body and a bottom body connected to the upper body and defines a cavity; the upper body defines a third through hole in the center, and a fourth through hole; and the rotation mechanism further comprises a knob, a first gear located at the center of the bottom body and a second gear engaged with the first gear; wherein the first and second gears are received in the cavity and positioned on the bottom body; the knob is fixed with a centre shaft of the second gear, and protrudes out of the upper body through the fourth through hole; and the second end of the rotation axis extends through the third through hole and is received in a center hole of the first gear.

5. The rotatory table lamp as described in claim 3, wherein the first connection rod defines a first connection dowel at the end away from the first hinge; and the first connection dowel penetrates through the first through hole and the fixing hole.

6. The rotatory table lamp as described in claim 3, wherein the second connection rod defines a second connection dowel at the end away from the second hinge.

7. The rotatory table lamp as described in claim 1, wherein the radians of the sectoral indented portion and the arc-shaped sliding groove are 180 degrees.

8. The rotatory table lamp as described in claim 1, wherein the holder is sleeve-shaped.

9. The rotatory table lamp as described in claim 1, wherein the powers of the first and the second lamps are separately controlled.

10. A rotatory table lamp comprising:

a connection element;

a rotation mechanism rotatably installed on the connection element;

a first lamp fixed on the connection element, comprising a connection rod, a light emitting device and a hinge joining the connection rod and the light emitting device; and a second lamp fixed on the rotation mechanism, wherein a structure of the second lamp is the same as that of the first lamp;

wherein the connection element comprises a connection platform and a connection cover mounted on the connection platform; the connection cover defines a first through hole and an arc-shaped through hole; and the connection platform defines a fixing hole coaxial with the first through hole, a second through hole in the center of the connection platform, a sectoral indented portion and an arc-shaped sliding groove corresponding to the arc-shaped through hole; wherein one end of the first lamp penetrates through the first through hole and the fixing hole and is fixed on the connection element; and one end of the second lamp penetrates through and rotatably slides along the arc-shaped through hole and is fixed on the rotation mechanism.

11. The rotatory table lamp as described in claim 10, wherein the rotatory table lamp further comprises a base; the rotation mechanism comprises a rotation axis, the rotation axis comprises a first end and a second end opposite to the first end; the first end protrudes from the second through hole, and the second end is rotatably connected with the base.

12. The rotatory table lamp as described in claim 11, wherein the rotation mechanism further comprises a supporting arm protruding radially from the first end and rotatably received in the sectoral indented portion; and the supporting arm comprises a fixing portion defined at the free end thereof and rotatably received in the arc-shaped sliding groove; and one end of the second lamp penetrates through the arc-shaped through hole and is fixed in the fixing portion.

13. The rotatory table lamp as described in claim 12, wherein the base comprises an upper body and a bottom body connected to the upper body and defines a cavity; the upper body defines a third through hole in the center, and a fourth through hole; and the rotation mechanism further comprises a knob, a first gear located at the center of the bottom body and a second gear engaged with the first gear; wherein the first and second gears are received in the cavity and positioned on the bottom body; the knob is fixed with a centre shaft of the second gear, and protrudes out of the upper body through the fourth through hole; and the second end of the rotation axis extends through the third through hole and is received in a center hole of the first gear.

14. The rotatory table lamp as described in claim 12, wherein the connection rod defines a connection dowel at the end away from the hinge; and the connection dowel penetrates from the first through hole and the fixing hole.

15. The rotatory table lamp as described in claim 10, wherein the radians of the sectoral indented portion and the arc-shaped sliding groove are 180 degrees.

16. The rotatory table lamp as described in claim 11, wherein the rotatory table lamp further comprises a holder, the holder is fixed on the base, and is column shaped.

* * * * *